US005116297A

United States Patent [19]

Stonecipher

[11] Patent Number: 5,116,297

[45] Date of Patent: May 26, 1992

[54] WEIGHT-LIFTING MACHINE

[76] Inventor: William L. Stonecipher, 7001 W. 69th Ter., Overland Park, Kans. 66204

[21] Appl. No.: 663,569

[22] Filed: Mar. 4, 1991

[51] Int. Cl.[5] ..... A63B 21/06

[52] U.S. Cl. ..... 482/97; 482/137

[58] Field of Search ..... 272/117, 118, 123, 134

[56] References Cited

U.S. PATENT DOCUMENTS

| | | | |
|---|---|---|---|
| 4,357,010 | 11/1982 | Telle | 272/117 |
| 4,406,452 | 9/1983 | Lapcevic | 272/117 X |
| 4,621,810 | 11/1986 | Cummins | 272/134 |
| 4,858,915 | 8/1989 | Szabo | 272/117 |
| 4,872,670 | 10/1989 | Nichols | 272/134 |
| 4,883,269 | 11/1989 | Shaver | 272/117 |
| 4,923,195 | 5/1990 | Calderode | 272/117 |

FOREIGN PATENT DOCUMENTS

| | | | |
|---|---|---|---|
| 2717373 | 10/1978 | Fed. Rep. of Germany | 272/117 |

*Primary Examiner*—Robert Bahr

*Attorney, Agent, or Firm*—Litman, McMahon & Brown

[57] ABSTRACT

A weight-lifting machine having engaging means such as a barbell that is advanceable by a use both vertically and horizontally. The weight-lifting machine includes a base and a vertical support structure extending upward therefrom. A pair of first pivotal members are pivotally secured to the vertical support structure at an upper end thereof. Each of a pair of second pivotal members are pivotally connected to each of the first pivotal members and engaging means such as a barbell, curl-bar or handles are removably securable to the second pivotal members. Through the cooperation of the pivotal action of the first pivotal members and the second pivotal members, a user may grasp or otherwise engage the engagement means and advance the engagement means through simultaneous vertical and horizontal motion. Telescoping beams extending from the vertical support structure to the second pivotal members restrict the range of pivotal motion of the second pivotal members and provide resistance to the pivoting of the second pivotal members so as to provide greater control to a user.

10 Claims, 2 Drawing Sheets

WEIGHT-LIFTING MACHINE

BACKGROUND OF THE INVENTION

The present invention relates to a single station weight-lifting machine.

Weight-lifting exercises have become an increasingly popular means for improving strength, muscle tone and overall fitness. The standard barbell and weight set, commonly referred to as free weights, is one of the more basic yet often preferred weight-lifting systems due to the generally free range of motions allowed during use and the natural feel of exercises using free weights.

A significant disadvantage to free weight systems is the need for a spotter during some exercises. Spotters can help prevent exercisers from accidentally dropping weights due to fatigue or loss of balance. Spotters can also assist in lifting the weight as the lifter becomes fatigued so that the lifter may complete more repetitions of a fixed weight. If a spotter is not available, the extent of the workout may be significantly reduced. Free weight systems often accommodate only those exercises that can be accomplished with the exerciser holding onto the barbell or dumbbell.

Many exercise devices have been developed that eliminate the need for a spotter and allow an exerciser to work muscles that can not be worked using a free weight system. Many such devices comprise a weight adjustable lever that may be moved through a single arcuate motion. An exerciser using such a device is forced to limit his or her exercises to those incorporating the arcuate motion of the device. Other devices specifically isolate a particular motion and allow the user to focus on exercising the muscles associated with that motion. Devices such as these which are directed to exercising specific muscle groups are impractical for most household use due to the large number of machines that would be required to obtain a comprehensive Workout.

SUMMARY OF THE INVENTION

The present invention provides a weight-lifting machine which allows the user to advance a barbell or other engaging means through a wide range of motions. The weight-lifting machine includes a base formed from two elongate base members spaced apart in parallel alignment by a crossmember. A pair of vertically extending support members extend upwardly from the elongate base members at a rearward end of the base.

Each of a pair of first pivotal members is pivotally connected at one end to an upper end of a respective vertically extending support member so as to form a first set of pivot points. The first pivotal members extend towards a front end of the base in parallel alignment and pivot about a horizontal axis extending through the first set of pivot points. A cross-member extends between the first pivotal members to provide structural rigidity and to maintain the first pivotal members in parallel and planar alignment.

Each of a pair of second pivotal members is pivotally connected at an upper end thereof to each of the first pivotal members so as to form a second set of pivot points spaced apart from the first set of pivot points. The second pivotal members pivot about a horizontal axis extending through the second set of pivot points.

Each second pivotal member comprises an upper arm and a lower arm angled apart from each other at an obtuse angle. Linearly aligned apertures extend through each of the second pivotal members in both the upper arms and the lower arms. The linearly aligned apertures are adapted to receive engaging means such as a barbell or handles which a user may engage or grasp in order to perform a weight-lifting exercise. The cooperation of the second pivotal members pivoting about the second set of pivot points and the first pivotal members pivoting about the first set of pivot points allows a user to advance the engaging means such as a barbell through a wide range of motions each having a vertical component and a horizontal component.

Each of a pair of telescoping beam members is pivotally connected at one end to each of the vertically extending support members and at an opposite end to a respective second pivotal member. The telescoping beam members function as stop means restricting the range of rotation of the second pivotal members with respect to the first pivotal members. The telescoping beam members also function as resistance means resisting rotation of the second pivotal members about the second pivot points so as to improve user control. The telescoping beam members are maintained in parallel and planar alignment with respect to each other by a cross-member extending therebetween. The telescoping beam members also generally extend in spaced and parallel alignment below respective first pivotal members.

Each telescoping beam member comprises an extension member slidingly received within an outer sleeve member. Each outer sleeve member is pivotally connected to a respective vertically extending support member and each extension member is pivotally connected to a lower end of the upper arm of a respective second pivotal member. The extension members are slidingly advanceable from a fully retracted position to a fully extended position such that in the fully retracted position the upper arms of the second pivotal members generally extend vertically and in the full extended position the upper arms of the second pivotal members are angled outwardly away from the rear of the weight-lifting machine.

Weight support posts are secured on the first pivotal members and the cross-member extending therebetween. Various combinations of free weights may be secured on the weight support posts to vary the weight to be lifted by a user. Spring loaded shock absorbers are pivotally connected at one end to each of the first pivotal members and at an opposite end to the elongate base members. The spring loaded shock absorbers prevent the first pivotal members from rotating below a certain point and absorb the impact when a user releases the engaging means.

The wide range of motions through which the engaging means such as a barbell may be advanced allows an exerciser to perform a wide range of exercises with the weight-lifting machine.

OBJECTS AND ADVANTAGES OF THE INVENTION

Therefore the principal objects and advantages of the present invention are: to provide a weight-lifting machine that may be used to perform a wide range of weight-lifting exercises; to provide such a machine that allows a user to exercise a wide range of muscles and muscle groups; to provide such a machine that allows a user to perform such weight-lifting exercises without the assistance of a spotter; to provide such a machine that allows a user to move a grasping means, such as a barbell, through a wide range of motions; to provide such a machine that allows a user to advance the grasping means through a range of motions which include both a vertical component and a horizontal component; to provide such a machine which in use closely approximates the feel of using a freeweight system; to provide such a machine that allows the user to vary the amount of weight lifted.

It is a further object of the present invention to provide a weight-lifting machine that is relatively compact; to provide such a machine that is particularly well adapted for home use; and to provide such a machine that is relatively lightweight and durable; to provide such a device that is relatively inexpensive to make, easy to manufacture and especially well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 3:
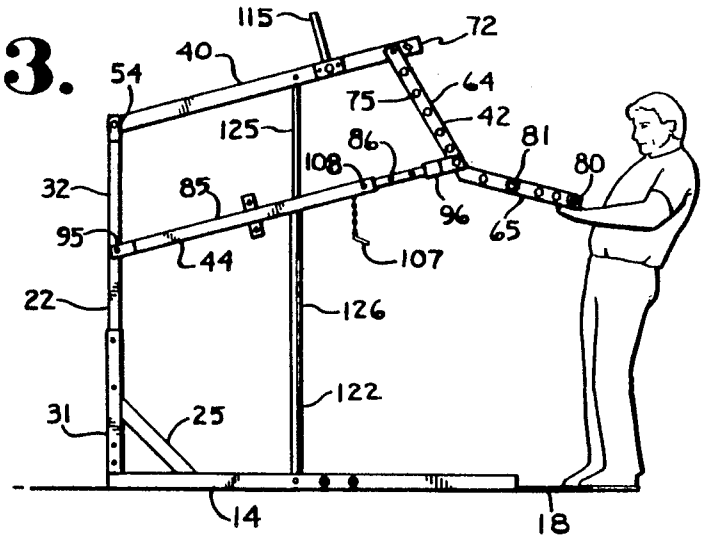
FIG. 3 is a side elevational view of the weight-lifting machine indicating a portion of a range of motion of the weight-lifting machine.
Figure 2:
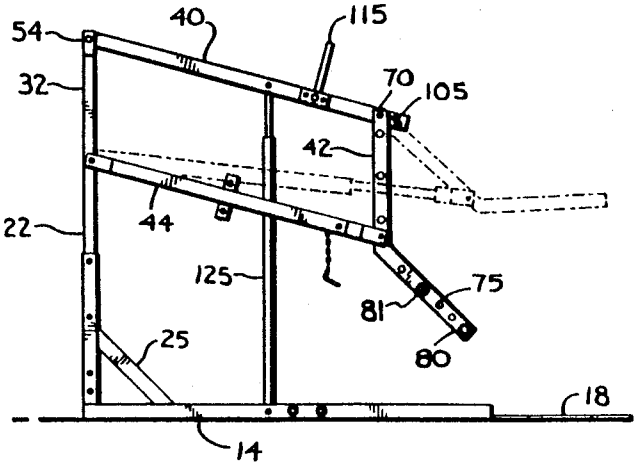
FIG. 2 is a side elevational view of the weight-lifting machine.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 represents a weight-lifting machine of the present invention. The weight-lifting machine 1 generally comprises a base 2, an upright support structure 3 extending upwardly from the base 2 and a pivotal, telescoping framework 4 pivotally secured to the upright support structure 3.

The base 2 includes a front 10 and a rear 11 and comprises a pair of base members 14 and a medial base cross member 16 each constructed of square tubing. The base members 14 are aligned in parallel and spaced relation. The medial base cross member 16 extends between the base members 14 generally medially thereto so as to maintain the base members 14 in parallel alignment and to provide structural integrity. A base plate 18 extends between and is secured to the base members 14 at the front 10 of the base 2.

The upright support structure 3 generally comprises a pair of vertical support members 22 secured to and extending upwardly in perpendicular alignment to respective base members 14 at the rear 11 of the base 2 so as to extend in parallel alignment with respect to each other. Each of a pair of angled brace members 25 extends at an angle from each vertical support member 22 to a respective base member 14 so as to provide structural support. A second cross member 28 extends horizontally between the vertical support members 22.

Each vertical support member 22 comprises a lower outer sleeve section 31 and an upper inner sleeve section 32. A lower portion of the upper inner sleeve section 32 is secured within an upper portion of the lower outer sleeve section 31. It is foreseen that the upper inner sleeve section 32 may be slidably advanceable within the lower outer sleeve section 31 so that the length or height of the vertical support members 22 would be selectively adjustable.

The pivotal, telescoping framework 4 generally comprises a pair of first pivotal members 40, a pair of second pivotal members 42 and a pair of telescoping members 44. The first pivotal members 40 are each pivotally connected at one end thereof to an upper end of a respective vertical support member 22 so as to be pivotal about a first horizontal axis extending through a first set of linearly aligned pivot points 54. A third cross-member 56 extends between the vertical support members 22 generally along the first horizontal axis.

The first pivotal members 40 are formed of square tubing and extend in planar and parallel alignment generally towards the front 10 of the base 2. A fourth cross member 60 extends between the pivotal members 40 in perpendicular alignment so as to maintain the first pivotal members 40 in parallel and planar alignment.

The second pivotal members 42 are formed of rectangular tubing and each includes an upper arm 64 and a lower arm 65. Each lower arm 65 extends at a obtuse angle with respect to a respective upper arm 64. In the preferred embodiment of the present invention, the angle between the upper arms 64 and respective lower arms 65 is approximately 135°.

Upper ends 66 of the upper arms 64 of the second pivotal members 42 are pivotally secured to a respective first pivotal member 40 at a second set of pivot points 70 such that the second pivotal members 42 are pivotal about a second horizontal axis extending through the second set of pivot points 70. The second pivotal members 42 are generally pivotally secured near ends 72 of the first pivotal members 40 spaced away from the upright support structure 3.

A plurality of apertures 75 extend through each of the second pivotal members 42 such that the apertures 75 of one second pivotal member 42 are linearly aligned with the apertures 75 of the other second pivotal member 42.

Figure 1:
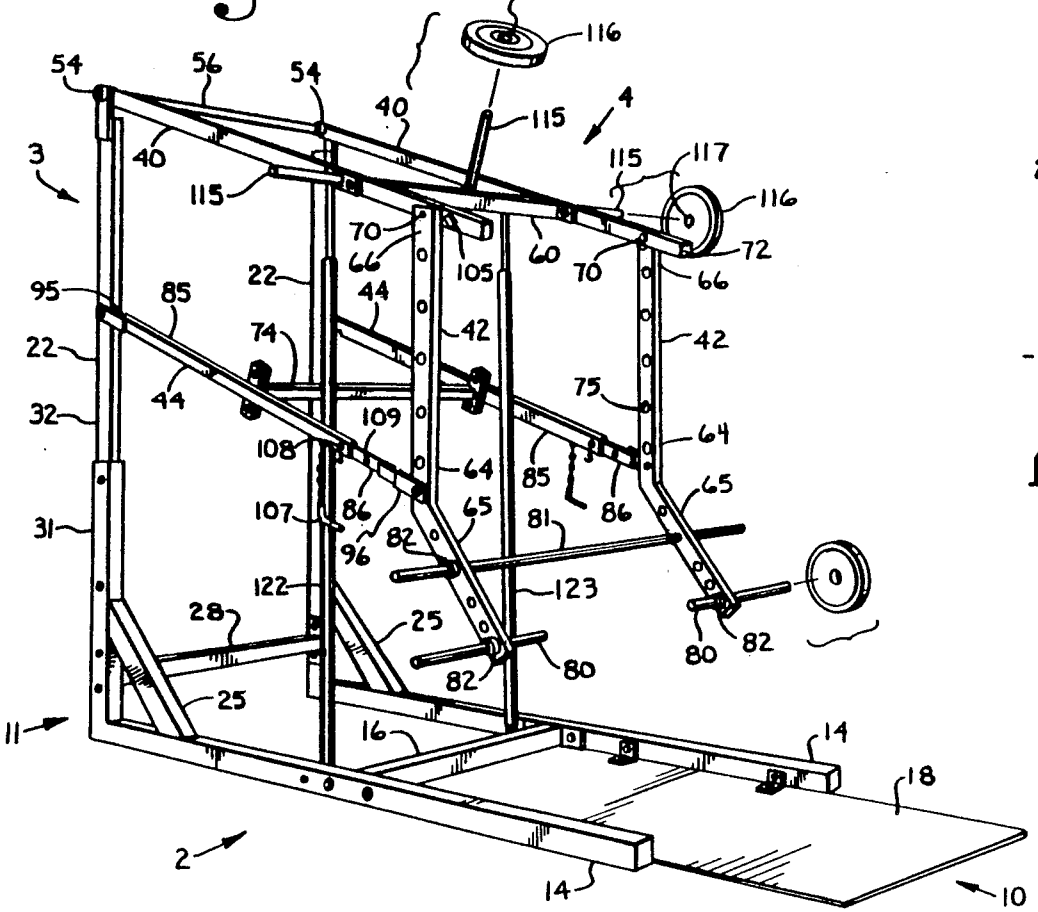
FIG. 1 is a perspective view of a weight-lifting machine embodying the present invention.

The linearly aligned apertures 75 serve as engaging means securement means. Engaging means, such as handles 80 or barbell 81, as shown in FIG. 1, are removably securable within linearly aligned apertures 75. The handles 80 or barbell 81 are positioned within linearly aligned apertures 75 and secured in place with collars 82. In the preferred embodiment of the present invention, five pairs of linearly aligned apertures 75 extend through the upper arms 64 of the second pivotal member 42 and five pairs of linearly aligned apertures extend through the lower arms 65 thereof. The handles 80, barbell 81 or other engaging means not shown, such as a curl bar, are securable to various pairs of linearly aligned apertures 75 depending on such factors as the type of exercise to be performed, the size of the user and the rang of motion sought.

The cooperation of the pivotal action of the first pivotal members 40 and the second pivotal members 42 allows a user or exerciser to advance the handles 80 or other engaging means through a wide range of motions and in particular allows the handles 80 or other engaging means to be simultaneously advanced through a range of motions each having a vertical component and a horizontal component. The engaging means may be advanced through various linear motions including vertically and horizontally as well as circular and arcuate motions. The ability to advance the engaging means through a wide range of motions allows a user to perform a wide range of exercises with the weight-lifting machine 1.

The telescoping beam members 44 function as stop means and resistance means to provide greater control to a user in advancing the engaging means by restricting the range of pivotal motion of the second pivotal members 42 and providing resistance to the rotation of the second pivotal members 42 about the second set of pivot points 70. The telescoping beam members 44 are pivotally connected at one end thereof to respective vertical support members 22 in spaced relation below the first pivotal members 40, and the telescoping beam members 44 are pivotally connected at an opposite end thereof to a lower end of the upper arms 64 of respective second pivotal members 42. The telescoping beam members 44 extend in planar and parallel alignment from the vertical support members 22 to the second pivotal members 42.

The telescoping beam members 44 each includes an outer sleeve member 85 and an extension member 86 slidably receivable within the outer sleeve member 85 so as to be telescopically advanceable therewith. In the preferred embodiment of the present invention, the outer sleeve members 85 of the first telescoping beam members 44 are pivotally connected to respective vertical support members 22 by connecting flanges 95, and the extension members 86 of the telescoping beam members 44 are pivotally connected to the respective second pivotal members 4 by connecting flanges 96. A fifth cross member 74 extends between the outer sleeve members 85 of the telescoping beam members 44 in perpendicular alignment therewith. It is foreseen that the extension members 86 of the telescoping beam members 44 may be pivotally connected to respective vertical support members 22. The frictional resistance created by the extension members 86 sliding within the outer sleeve members 85 provides resistance to the pivoting of the second pivotal members 42 about the second horizontal axis so as to increase the control of the user over such pivoting action.

The extension members 86 of the telescoping members 44 are each retractable to a completely retracted position wherein an abutting edge 100 of the connecting flange 96 engages an open end edge 101 of a respective outer sleeve member 85 of a respective telescoping member 44. The abutment of the abutting edge 100 against the open end edge 101 serves as stop means preventing the second pivotal members 42 from being further rotated towards the vertical support structure 4.

When the extension members 86 of the telescoping members 44 are retracted into the completely retracted position, the upper arms 64 of the second pivotal members 42 generally extend vertically such that respective first pivotal members 40, upper arms 64 of the respective second pivotal members 42, respective telescoping members 44 and portions of respective vertical support members 22 between respective first pivotal members 40 telescoping members 44 generally form a parallelogram. When the upper arms 64 of the second pivotal members 42 extend vertically, the lower arms 65 thereof are angled downwardly generally towards the front 10 of the base 2.

From the fully retracted position, the extension members 86 of the telescoping members 44 may be telescopically advanced out of the outer sleeve members 85 as the second pivotal members 42 are pivotally advanced about the second horizontal axis and generally away from the upright support structure 3. Each of a pair of stops 105 extends from the first pivotal member 40 into a rotational path of the second pivotal members 42. The stops 105 are positioned so as to engage the second pivotal members 42 when the second pivotal members 42 are rotated to a position such that further rotation would greatly reduce the leverage a user would have to advance the second pivotal members 42 back towards a vertical alignment. In the preferred embodiment of the invention, the stops 105 are positioned such that the upper arm 64 of the second pivotal members 42 are engaged and prevented from rotating more than 150° with respect to the portion of the first pivotal members 40 extending towards the upright support structure 3.

Position locking means such as locking pins 107 are operable to lock the extension members 86 of the telescoping beam members 44 in the completely retracted position or in various degrees of extension. A first bore hole 108 extends through the outer sleeve member 85 of the telescoping beam members 44 at an end thereof spaced away from the upright support structure 3. Alignable bore holes 109 extend through the extension members 86 in spaced relation such that the independently alignable bore holes 109 are alignable with the first bore holes 108.

To lock the telescoping beam members 44 in a particular extension position, the extension members 86 are slidingly advanced to the desired extension position and then slight adjustments as to extension are made until an alignable bore hole 109 in each extension member 86 is aligned with the first bore hole 108 in each outer sleeve member 85. The locking pins 107 are then inserted through the first bore holes 108 and the alignable bore holes 109 so as to prevent axial motion of the extension members 86 within the outer sleeve members 85. The looking pins 107 may be secured to the outer sleeve members 85 by a connector such as a chain 110 and the locking pins 107 when not in use may be held out of the way by a hook 111.

The weight-lifting machine 1 further includes weight support means such as weight support posts 115 secured to the pivotal, telescoping framework 4 in spaced relation to the first set of pivot points 54. The weight support posts 115 are adapted to removably receive circular weighted discs or weights 116 having a post receiving aperture 117 extending therethrough. As shown in FIG. 1 a weight support post 115 extends perpendicularly to and generally vertically away from the fourth cross member 60. A weight support post 110 also extends perpendicularly and horizontally away from each of the first pivotal members 40. The engaging means may also function as weight support means wherein weights 116 would be removably securable to ends of engaging means such as barbells 81, curl bars or handles 80. It is foreseeable that additional weight support posts 115 may be positioned in different positions on the pivotal, telescoping framework 4.

The weight of the pivotal, telescoping framework 4, causes the pivotal, telescoping framework 4 to naturally pivot or rotate downward towards the base 2. Each of a pair of spring loaded shock absorbers 122 is pivotally secured at one end to a respective first pivotal member 40 and at an opposite end to a respective base member 14. The spring loaded shock absorbers 122 prevent the first pivotal members 40 from rotating or pivoting below a predetermined level and maintain the lower arms 65 of the second pivotal members 42 a minimum distance above the base 2. The lower ends of the lower arms 65 are preferably maintained at least a foot above the base 2.

Figures 4, 5, 6, 7, 8:
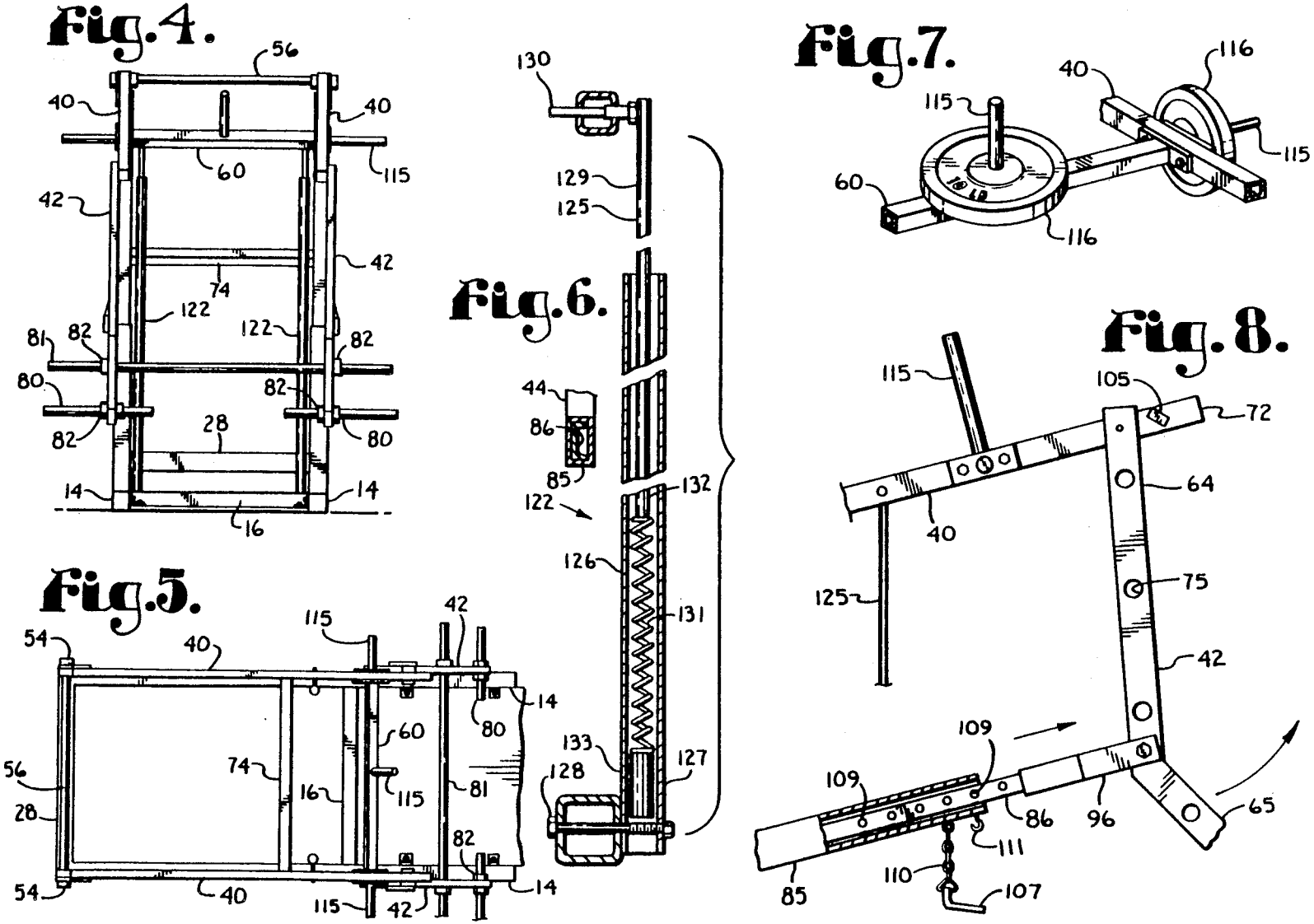
FIG. 4 is a front elevational view of the weight-lifting machine.
FIG. 5 is a top plan view of the weight-lifting machine.
FIG. 6 is an enlarged, fragmentary cross-sectional view of the weight-lifting machine taken generally along line 6—6 in FIG. 2 and particularly showing a spring loaded shook absorber.
FIG. 7 is an enlarged, fragmentary view of the weight-lifting apparatus showing the positionability of free weights thereon.
FIG. 8 is an enlarged, fragmentary view of the weight-lifting machine with portions broken away to show interior detail thereof and indicating the range of motion of the weight-lifting machine.

As shown in FIG. 6, the spring loaded shock absorbers 122 generally comprise a cylindrical rod 125 slidingly received within a cylindrical tube 126. A lower end 127 of each cylindrical tube 126 is pivotally secured to respective base members 14 by a bottom pivot pin 128. An upper end 129 of each cylindrical rod 125 is pivotally secured to a respective first pivotal members 40 by a top pivot pin 130. A coil spring 131 is secured to a lower end 132 of the cylindrical rod 125 in axial alignment. The coil spring 131 and the cylindrical rod 125 extend within the cylindrical tube 126. A cylindrical plug 133 is positioned within the cylindrical tube 126 just above the bottom pivot pin 128.

The coil spring 131 is not secured to the cylindrical plug 133 or the cylindrical tube 126 such that the cylindrical rod 125 and the coil spring 131 freely slide upward Within the cylindrical tube 126 when a user engages the engaging means so as to advance the first pivotal members 40 in a generally upward arcuate motion. When the user releases the engaging means with the pivotal telescoping framework 4 in a raised position, the coil springs 131 within the spring loaded shock absorbers 122 dampen the fall of the pivotal telescoping framework 4.

The weight-lifting machine 1 allows a user to perform a wide range of exercises. As shown in FIG. 3, the user may stand on the base plate 18 facing a front of the weight-lifting machine 1, corresponding to the front 10 of the base 2, and then engage the engaging means secured to the second pivotal members 42 and advance the engaging means through a curling motion or a straight up and down motion as in a military press. In such a position the user may also advance the engaging means away from his or her body in an upwardly angled motion. Such a motion would be extremely difficult with a free weight system.

The user may position a bench (not shown) on the base plate 18 and advance the engaging means vertically while laying on the bench so as to perform a bench press. While laying on the bench, with his or her head positioned away from the machine, the user may push against the fourth cross member 60 so as to exercise the his or her legs. Further exercises may be performed with the user standing between the first pivotal members 40 and the telescoping beam members 44. Positioned therebetween, the user may face the rear of the weight-lifting machine, corresponding to the rear 11 of the base 2, and engage the engaging means such as a barbell 81 (not shown) with the back of his or her leg and advance the barbell through various motions with the legs. A padded yoke (not shown) may also be secured within the apertures 75 to allow the user to perform squats.

It is foreseen that various attachments may be developed for the machine allowing the user to perform additional exercises. For example, it is foreseen that a yoke attachment might be secured to the ends 72 of the first pivotal members 40 so as to allow the user to perform squats. A dip bar or a chinup bar might be attached to the upright support structure 3. Similarly a weight and pulley system might be incorporated into the upright support structure 3.

It is foreseen that various materials may be used to construct the weight lifting machine. Such materials are preferably lightweight but strong. Chomalloy metal alloy is a preferred material of construction for the weight lifting machine.

It is to be understood that while certain forms of the present invention have been illustrated and described herein, it is not to be limited to the specific forms or arrangement of parts described and shown.

What is claimed and desired to be secured by Letters Patent is as follows:

1. A weight-lifting machine comprising:

(a) a base having a front and a rear;

(b) a pair of vertical support members extending vertically upward from said rear of said base in spaced relation to each other;

(c) a pair of first pivotal members pivotally secured at a first set of pivot points to respective vertical support members so as to extend towards said front of said base in planar alignment and so as to be pivotal about a first horizontal axis extending through said first set of pivot points;

(d) a first cross-member secured to and extending between said first pivotal members so as to maintain said first members in planar alignment;

(e) a pair of second pivotal members pivotally securable at a second set of pivot points positioned on respective pivotal members in spaced relation to said first set of pivot points so as to allow said second pivotal members to pivot about a second horizontal axis extending through said second set of pivot points;

(f) engaging means for engagement by a user of said machine;

(g) means for securing said engaging means to said second pivotal members; said second pivotal members cooperating with said first pivotal member such that said engaging means may be engaged by a user and advanced through a range of motions having a horizontal component and a vertical component;

(h) a pair of telescoping beams each pivotally connected at a first end thereof to respective vertical support members and at a second end thereof to respective second pivotal members;

(i) a second cross-member secured to and extending between said telescoping beams so as to maintain said first telescoping beams in planar alignment; and (j) weight support means secured to said weight-lifting machine in spaced relationship to said first set of pivot points and adapted to removably receive a plurality of weights so as to vary the weight to be lifted by a user.

2. The weight-lifting machine as described in claim 1 further comprising:

(a) a first stop and a second stop secured to respective first pivotal members and extending into a rotational path of second pivotal members so as to engage said second pivotal members and prevent said second pivotal members for rotating therebeyond.

3. A weight-lifting machine comprising:

(a) vertical support means;

(b) a first pivotal member pivotally securable about a first pivot point on said vertical support means so as to allow said first pivotal member to pivot about a first horizontal axis extending through said first pivot point;

(c) a second pivotal member pivotally securable at a second pivot point positioned on said first pivot member in spaced relation to said first pivot point so as to allow said second pivotal member to pivot about a second horizontal axis extending through said second pivot point;

(d) engaging means for engagement by a user of said machine;

(e) means for securing said engaging means to said second pivotal member; said second pivotal member cooperating with said first pivotal member such that said engaging means may be engaged by a user and advanced through a range of motions having a horizontal component and a vertical component;

(f) weight support means secured to said weight-lifting machine in spaced relationship to said first pivot point and adapted to removably receive a plurality of weights so as to vary the weight to be life by a user; and (g) stop means for restricting a range of motion of said second pivotal member about said second pivot point;

(h) said stop means comprising a telescoping beam pivotally connected at a first end of said telescoping beam to said vertical support means and at a second end of said telescoping beam to said second pivotal member.

4. The weight-lifting machine as disclosed in claim 3 further comprising:

(a) a base; and (b) said vertical support means extending vertically upward from said base.

5. A weight-lifting machine comprising:

(a) vertical support means;

(b) a first pivotal member pivotally securable to about first pivot point on said vertical support means so as to allow said first pivotal member to pivot about a first horizontal axis extending through said first pivot point;

(c) a second pivotal member pivotally securable at a second pivot point positioned on said first pivotal member in spaced relation to said first pivot point so as to allow said second pivotal member to pivot about a second horizontal axis extending through said second pivot point;

(d) engaging means for engagement by a user of said machine;

(e) means for securing said engaging means to said second pivotal member; said second pivotal member cooperating with said first pivotal member such that said engaging means may be engaged by a user and advanced through a range of motions having a horizontal component and a vertical component;

(f) weight support means secured to said weight-lifting machine in spaced relationship to said first pivot pint and adapted to removably receive a plurality of weights so as to vary the weight to be life by a user;

(g) resistance means for resisting pivoting of said second pivotal member about said second pivot point;

(h) said resistance means comprising a telescoping beam pivotally connected at a first end of said telescoping beam to said vertical support means and at a second end of said telescoping beam to said second pivotal member.

6. The weight-lifting machine as discloses in claim 5 further comprising:

(a) a base; and (b) said vertical support means extending vertically upward from said base.

7. A weight-lifting machine comprising:

(a) a base having a front and a rear;

(b) a pair of vertical support members extending vertically upward from said rear of said base in spaced relation to each other;

(c) a pair of first pivotal members pivotally secured at a first set of pivot points to respective vertical support members so as to extend towards said front of said base in planar alignment and so as to be pivotal about a first horizontal axis extending through said first set of pivot points;

(d) a pair of second pivotal members pivotally securable at a second set of pivot points positioned on respective first pivotal members respectively in spaced relation to said first set of pivot points so as to allow said second pivotal members to pivot about a second horizontal axis extending through said second set of pivot points;

(e) engaging means for engagement by a user of said machine;

(f) means for securing said engaging means to said second pivotal members; said second pivotal members cooperating with said pivotal members such that said engaging means may be engaged by a user and advanced through a range of motions including a horizontal component and a vertical component;

(g) weight support means secured to said weight-lifting machine in spaced relationship to said first set of pivot points and adapted to removably receive a plurality of weights so as to vary the weight to be lifted by a user; and (h) resistance means for resisting pivoting of said second pivoting members about said second horizontal axis;

(i) said resistance means comprising a pair of telescoping beams pivotally connected at a first end thereof to respective vertical support members and at a second end thereof to respective second pivotal members.

8. The weight-lifting machine as described in claim 7 further comprising:

(a) a first cross-member secured to and extending between said first pivotal members and so as to maintain said first pivotal members in planar alignment; and (b) a second cross-member secured to and extending between said telescoping beam members so as to maintain said telescoping beam members in planar alignment.

9. A weight-lifting machine comprising:

(a) a base having a front and a rear;

(b) a pair of vertical support members extending vertically upward from said rear of said base in spaced relation to each other;

(c) a pair of first pivotal members pivotally secured at a first set of pivot points to respective vertical support members so as to extend towards said front of said base in planar alignment and so as to be pivotal about a first horizontal axis extending through said first set of pivot points;

(d) a pair of second pivotal members pivotally securable at a second st of pivot points positioned on respective first pivotal members respectively in spaced relation to said first set of pivot points so as to allow said second pivotal members to pivot about a second horizontal axis extending through said second set of pivot points;

(e) engaging means for engagement by a user of said machine;

(f) means for securing said engaging means to said second pivotal members; said second pivotal members cooperating with said pivotal members such that said engaging means may be engaged by a user and advanced through a range of motions including a horizontal component and a vertical component;

(g) weight support means secured to said weight-lifting machine in spaced relationship to said first set of pivot points and adapted to removably receive a plurality of weights so as to vary the weight to be lifted by a user; and (h) stop means for restricting a range of motion of said second pivotal members about said second horizontal axis;

(i) said stop means comprising a pair of telescoping beams pivotally connected at a first end thereof to said respective vertical support members and at a second end thereof to said second pivotal members.

10. The weight-lifting machine as described in claim 9 further comprising:

(a) a first cross-member secured to and extending between said first pivotal members and so as to maintain said first pivotal members in planar alignment; and (b) a second cross-member secured to and extending between said telescoping beam members so as to maintain said telescoping beam members in planar alignment.

* * * * *